US009284768B2

(12) United States Patent
Sasaki

(10) Patent No.: US 9,284,768 B2
(45) Date of Patent: Mar. 15, 2016

(54) POWER DOOR OPENING/CLOSING APPARATUS

(71) Applicant: MITSUI KINZOKU ACT CORPORATION, Yokohama-shi, Kanagawa (JP)

(72) Inventor: Kazuyuki Sasaki, Yokohama (JP)

(73) Assignee: MITSUI KINZOKU ACT CORPORATION, Yokohama-shi (JP)

( * ) Notice: Subject to any disclaimer, the term of this patent is extended or adjusted under 35 U.S.C. 154(b) by 0 days.

(21) Appl. No.: 14/275,238

(22) Filed: May 12, 2014

(65) Prior Publication Data

US 2014/0373454 A1 Dec. 25, 2014

(30) Foreign Application Priority Data

Jun. 19, 2013 (JP) ..... 2013-128156

(51) Int. Cl.
*E05F 11/24* (2006.01)
*E05F 15/63* (2015.01)
*E05F 15/70* (2015.01)

(52) U.S. Cl.
CPC *E05F 15/63* (2015.01); *E05F 15/70* (2015.01)

(58) Field of Classification Search
CPC ..... E05F 15/63
USPC ..... 49/339, 340, 341, 344, 506; 296/56; 74/89.23, 89.36, 89.37, 89.39, 89.4, 74/89.41, 89.45
See application file for complete search history.

(56) References Cited

U.S. PATENT DOCUMENTS

| | | | | |
|---|---|---|---|---|
| 4,497,135 | A * | 2/1985 | Vetter | 49/280 |
| 7,275,631 | B2 * | 10/2007 | Hsieh | 192/226 |
| 7,774,984 | B2 * | 8/2010 | Hsu | 49/341 |
| 8,365,469 | B2 * | 2/2013 | Kowalczyk et al. | 49/139 |
| 8,596,153 | B2 * | 12/2013 | Arenz | 74/89.23 |
| 8,677,689 | B1 * | 3/2014 | Draper et al. | 49/281 |
| 2004/0113574 | A1 * | 6/2004 | Hsieh | 318/275 |
| 2005/0172559 | A1 * | 8/2005 | Hsieh | 49/140 |
| 2005/0178066 | A1 * | 8/2005 | Drux et al. | 49/340 |
| 2007/0051046 | A1 * | 3/2007 | Yoshida | 49/345 |

FOREIGN PATENT DOCUMENTS

JP 2005-82019 A 3/2005

* cited by examiner

*Primary Examiner* — Jerry Redman
(74) *Attorney, Agent, or Firm* — Foley & Lardner LLP

(57) ABSTRACT

A power door opening/closing apparatus includes: a first unit including the motor, a first unit case including the motor, a first transmission mechanism received in the first unit case, and a rotation sensor which is received within the first unit case, and which is one of electrical components; and a second unit which includes a second unit case connected to the first unit case by a fixing member, a second transmission mechanism rotatably received within the second unit case, and connected to the first transmission mechanism, and an output shaft connected to an output side of the second transmission mechanism, and arranged to transmit a rotation of the second transmission mechanism to the door, and which does not include an electrical component.

6 Claims, 9 Drawing Sheets

POWER DOOR OPENING/CLOSING APPARATUS

BACKGROUND OF THE INVENTION

This invention relates to a power door opening/closing apparatus arranged to open and close a door by a power of a motor.

A door such as a back door and a sliding door of a vehicle can be electrically opened and closed by a power door opening/closing apparatus, in addition to a manual operation. The power door opening/closing apparatus includes a motor, an output portion arranged to output a power of the motor, and a transmission mechanism arranged to transmit the power of the motor to the output portion. The power door opening/closing apparatus is provided to a vehicle body, or a door provided to the vehicle body to be opened and closed. The power door opening/closing apparatus moves the door in the open direction or in the close direction by the power outputted from the output portion.

For example, a patent document 1 (Japanese Patent Application Publication No. 2005-082019) discloses a power door opening/closing apparatus including electrical components such as an electromagnetic clutch arranged to switch a connection state in which a rotation of a motor can be transmitted to an output portion, and a disconnection state in which the rotation of the motor cannot be transmitted to the output portion, and a rotation sensor (which is not described in the patent document 1) arranged to sense a rotation of a transmission mechanism. The electromagnetic clutch is controlled by a control section. When the door is manually opened and closed, the electromagnetic clutch is switched to the disconnection state. Moreover, when the door is electrically opened and closed, the electromagnetic clutch is switched to the connection state. Furthermore, the rotation sensor senses an open position and a close position of the door, and an open direction and a close direction of the door by sensing the rotation of the transmission mechanism.

SUMMARY OF THE INVENTION

However, in the above-described power door opening/closing apparatus, the motor is connected to a single case. Moreover, mechanism components (transmission mechanism) constituted by reduction gears, shafts and so on, and the electrical components such as the electromagnetic clutch and the rotation sensor are received within the case. Therefore, in the assembly operation or the inspection of the power door opening/closing apparatus, it is not possible to confirm the operation of the only the electrical component, and to confirm the operation of the only mechanism. Accordingly, the assembly operation of the apparatus is inefficient. This causes the decrease of the productivity.

It is, therefore, an object of the present invention to provide a power door opening/closing apparatus which is devised to solve the above mentioned problems, and to improve a productivity.

According to one aspect of the present invention, a power door opening/closing apparatus arranged to open and close a door by a power of a motor, the power door opening/closing apparatus comprises: a first unit including the motor, a first unit case including the motor, a first transmission mechanism received in the first unit case, and arranged to transmit a rotation of the motor, and a rotation sensor which is received within the first unit case, which is one of electrical components, and which is arranged to sense a rotation of the first transmission mechanism; and a second unit which includes a second unit case connected to the first unit case by a fixing member, a second transmission mechanism rotatably received within the second unit case, and connected to the first transmission mechanism, and an output shaft connected to an output side of the second transmission mechanism, and arranged to transmit a rotation of the second transmission mechanism to the door, and which does not include an electrical component.

DETAILED DESCRIPTION OF THE INVENTION

Figure 1:
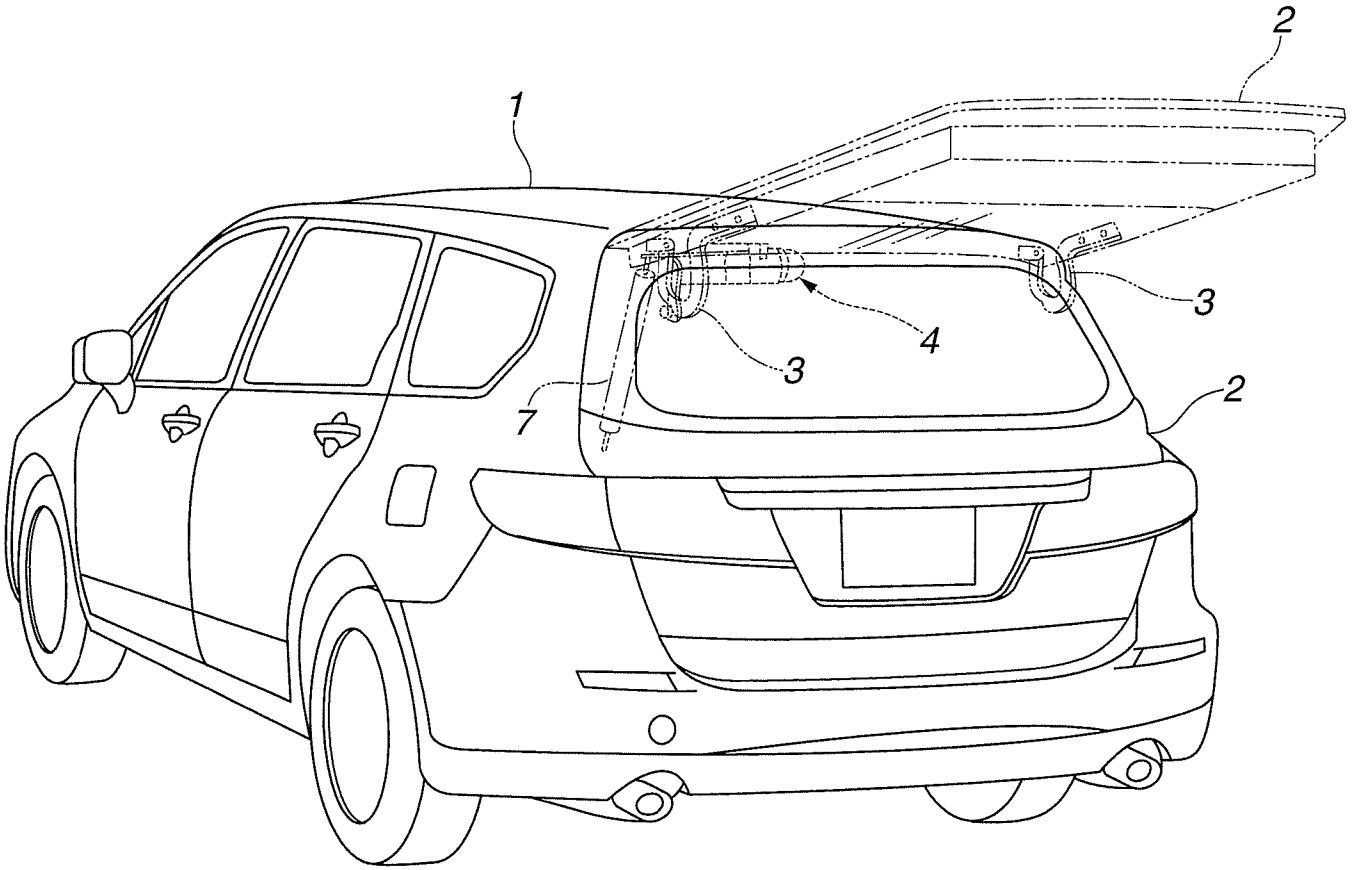
FIG. 1 is a perspective view showing a rear portion of a vehicle to which the present invention is applied.
Figure 2:
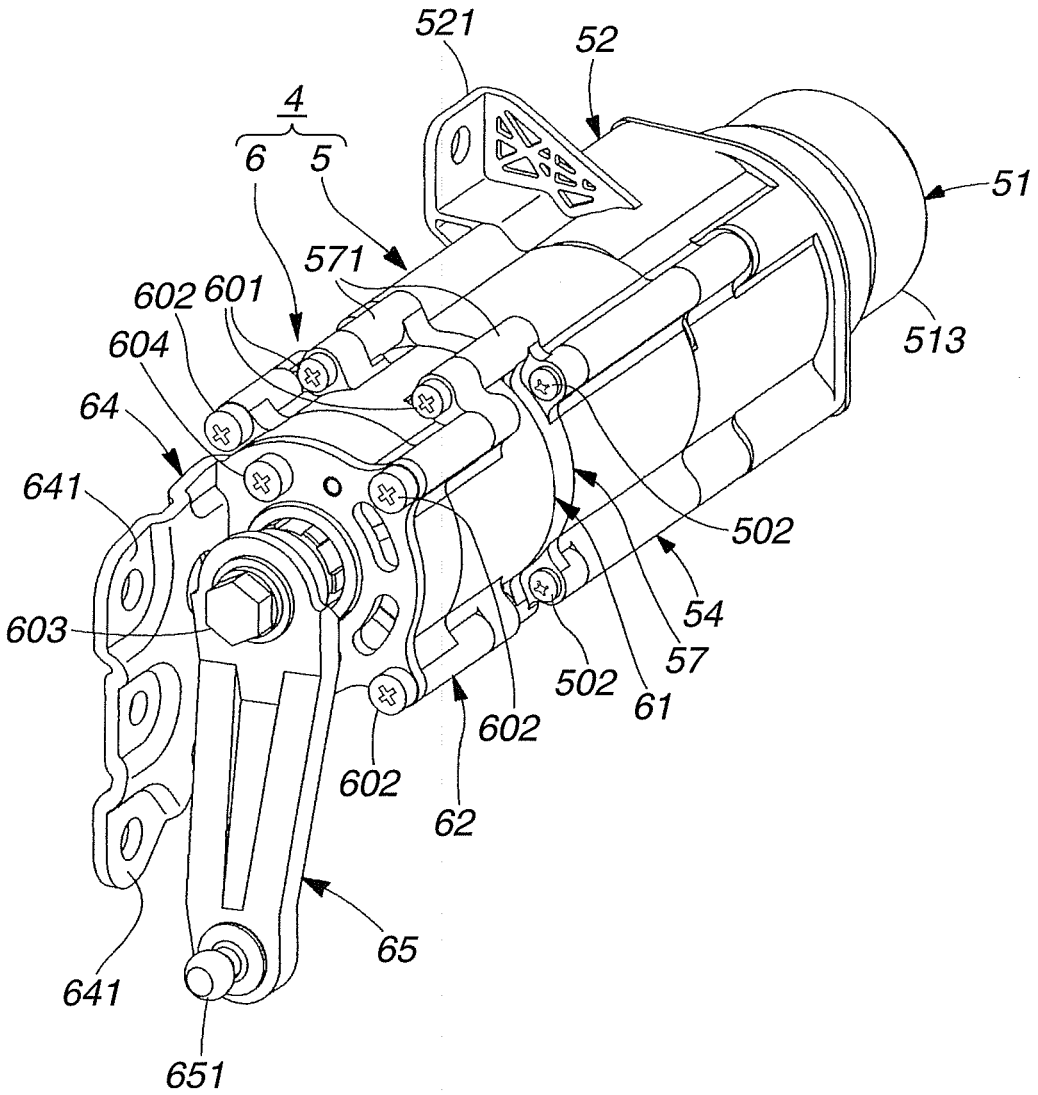
FIG. 2 is a perspective view showing a power door opening/closing apparatus according to the present invention.
Figure 3:
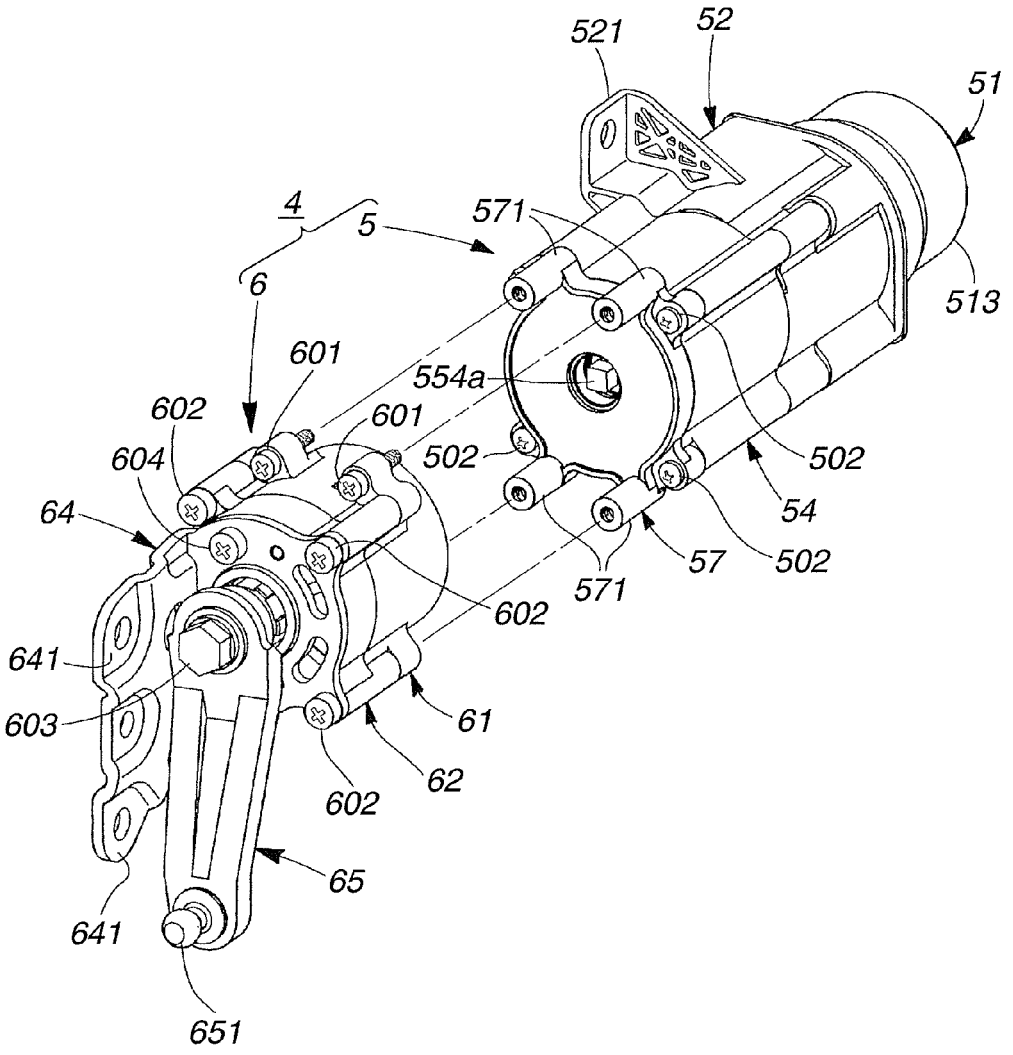
FIG. 3 is a perspective view showing a state in which a first unit and a second unit of the power door opening/closing apparatus of FIG. 2 are separated.

Hereinafter, one embodiment of the present invention is illustrated. FIG. 1 is a perspective view showing a vehicle as viewed from a diagonally rearward direction of the vehicle. A numeral 1 is a vehicle body. A numeral 2 is a back door which is supported to be opened and closed in upward and downward directions by left and right door hinges 3 that are provided at rear upper portions of the vehicle body 1. The back door 2 is pivotally supported by the door hinges 3 to be opened and closed. With this, the back door 2 is arranged to be moved between a close position (a position shown by a solid line in FIG. 1) at which the back door 2 closes a rear opening of the vehicle body 1, and an open position (a position shown by a two dot chain line in FIG. 1) at which the rear end portion of the back door 2 is tipped up so that the back door 2 opens the rear opening.

When the back door 2 is positioned at the close position, a door latch device (not shown) provided at a lower central portion of the back door 2 is engaged with a striker (not shown) of the vehicle body 1. With this the back door 2 is held at the close position.

There is provided an air damper 7 which is disposed between the vehicle body 1 and the back door 2, and which includes an upper end portion pivotally supported by the back door 2, and a lower end portion pivotally supported by the vehicle body 1. The air damper 7 is arranged to provide an urging force in the open direction (that is, in the upward direction), to the back door 2 for relieving an operation force for moving the back door 2 in the open direction.

There is provided a power door opening/closing apparatus 4 which is provided at an upper portion of the rear opening of the vehicle body 1, and which is arranged to electrically open and close the back door 2 by a power of a motor 51 described later.

As shown in FIG. 2 to FIG. 5, the power door opening/closing apparatus 4 has a substantially cylindrical overall shape. The power door opening/closing apparatus 4 is mounted to the vehicle body 1 so that the power door opening/closing apparatus 4 has a central axis of the cylindrical shape which directs in leftward and rightward directions of the vehicle (leftward and rightward directions in FIG. 5). The power door opening/closing apparatus 4 includes a first unit 5 which includes electrical components including the motor 51; and a second unit 6 which is a component different from the first unit 5, and which does not include an electrical component. Besides, a leftward direction and a rightward direction which are used in below illustrations correspond to a leftward direction and a rightward direction in FIG. 5 and FIG. 7.

Figure 4:
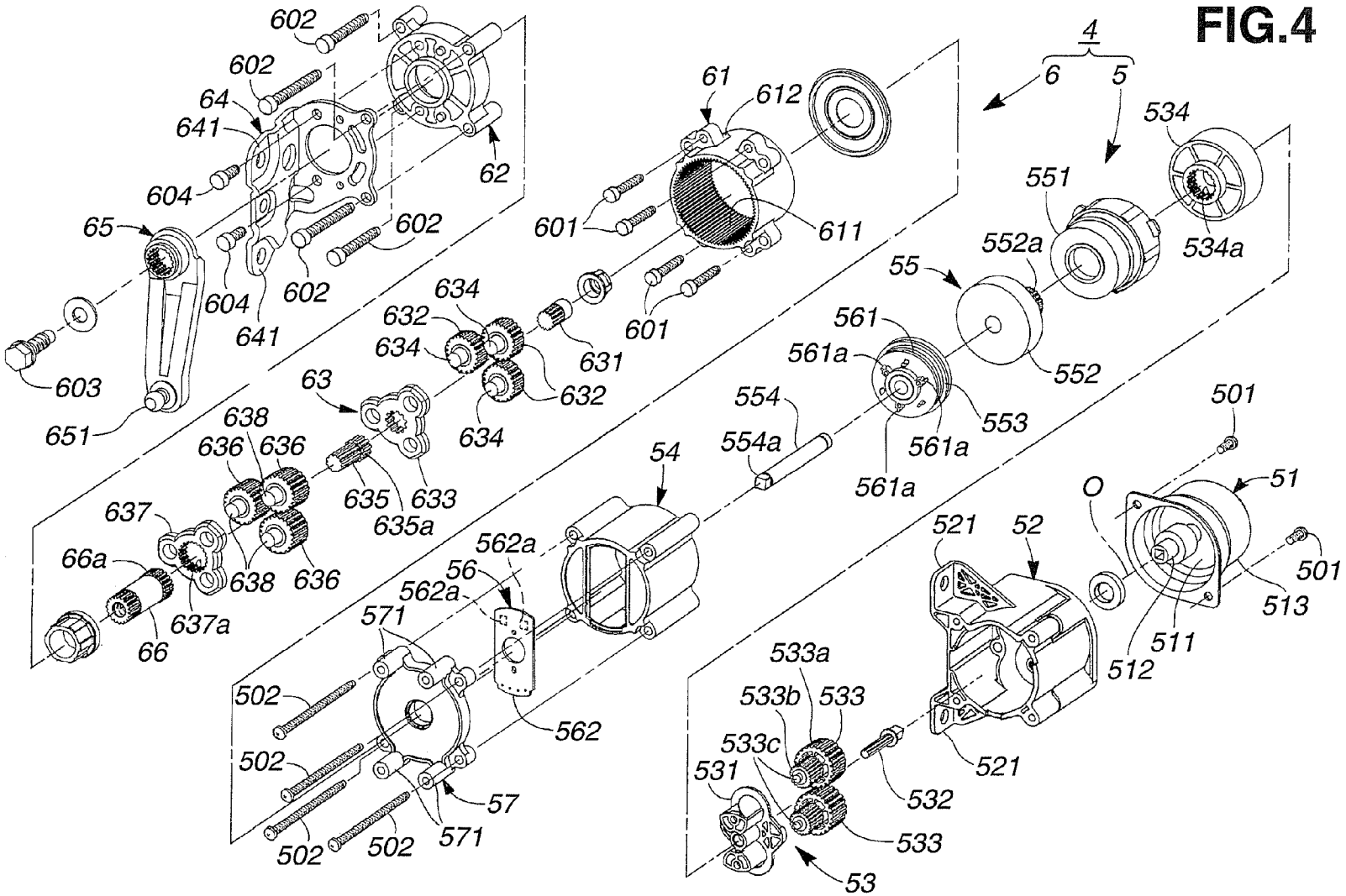
FIG. 4 is an exploded perspective view showing the power door opening/closing apparatus of FIG. 2.
Figure 5:
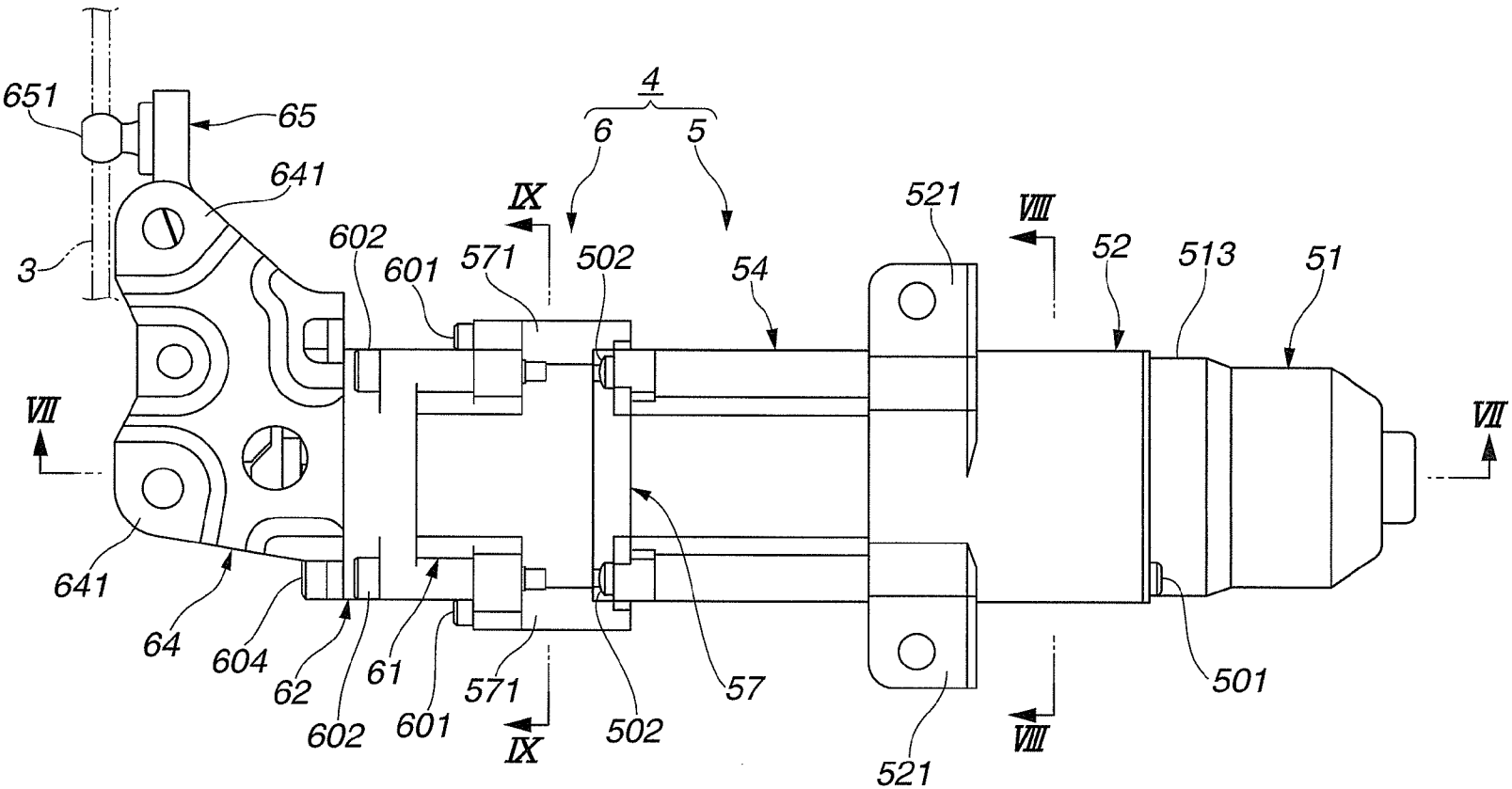
FIG. 5 is a plan view showing the power door opening/closing apparatus of FIG. 2.
Figure 7:
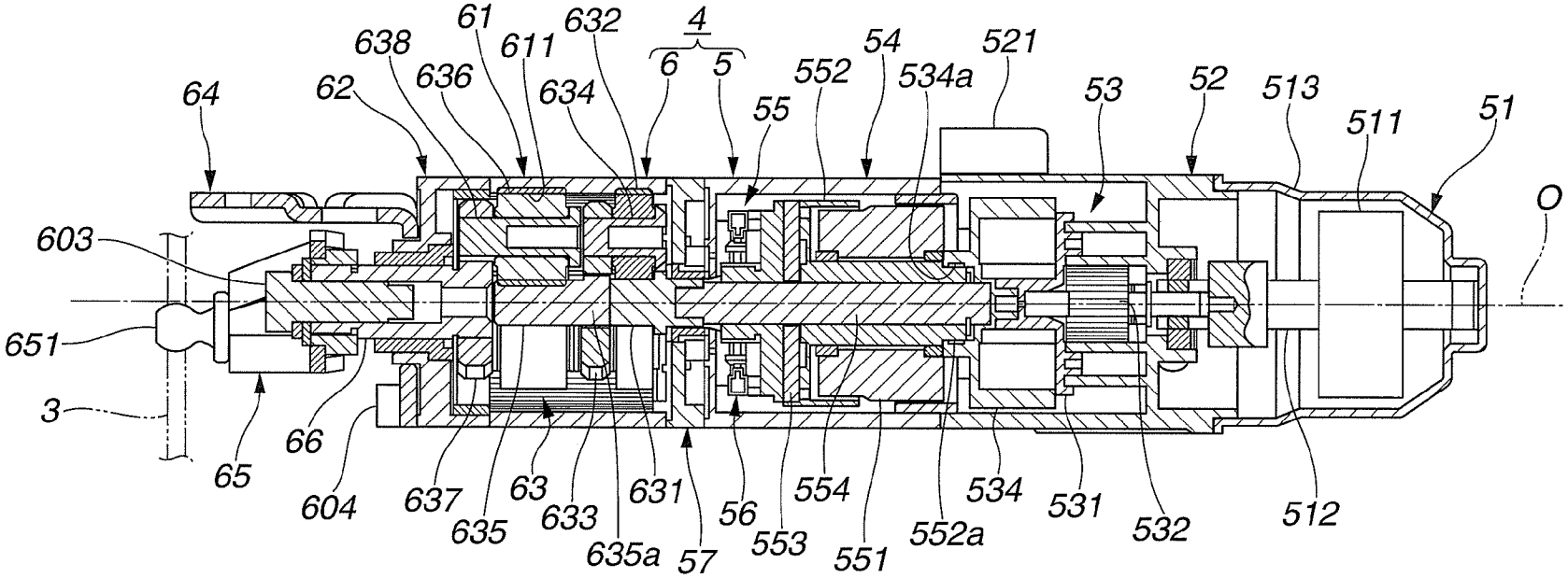
FIG. 7 is a transverse sectional view taken along a section line VII-VII of FIG. 5.

As shown in FIG. 4 and FIG. 7, the first unit 5 includes the motor 51 which is the electrical component; a cylindrical gear case 52 which includes a right end portion connected to a case 513 of the motor 51; a planetary gear mechanism 53 which is a speed reduction mechanism that is received within the gear case 52, and that constitutes a first transmission mechanism; a cylindrical clutch case 54 connected to a left end portion of the gear case 52; an electromagnetic clutch 55 which is received within the clutch case 54, which is the electrical component, and which constitutes the first transmission mechanism together with the planetary gear mechanism 53; a rotation sensor assembly 56 which is the electrical component, and which is arranged to sense the opening operation and the closing operation of the back door 2 through various elements; and a sensor cover 57 closing a left end portion of the clutch case 54.

Besides, the gear case 52, the clutch case 54, and the sensor cover 57 correspond to a first unit case in the present invention. However, the present invention is not limited to this embodiment. For example, the gear case 52 and the clutch case 54 may be integrally formed. That is, the first unit case can have any shapes as long as the first unit case can receive the speed reduction mechanism and/or the electromagnetic clutch 55 which constitute the transmission mechanism.

As shown in FIG. 4 and FIG. 7, the gear case 52 is fixed to the case 513 of the motor 51 by two bolts 501 parallel to an axis (hereinafter, referred to as a "motor rotational axis O") of a rotational shaft 512 of a rotor 511 of the motor 51 so that the central axis of the cylindrical shape of the gear case 52 corresponds to (is aligned with) the motor rotational axis O. The gear case 52 includes two mounting flap portions 521 which are integrally formed on an outer circumference surface of the gear case 52, and which is for mounting the power door opening/closing apparatus 4 to the vehicle body 1 by bolts (not shown). Besides, the power door opening/closing apparatus 4 is fixed to the vehicle body 1 so that the mounting flap portions 521 are positioned on the upper side.

Figure 8:
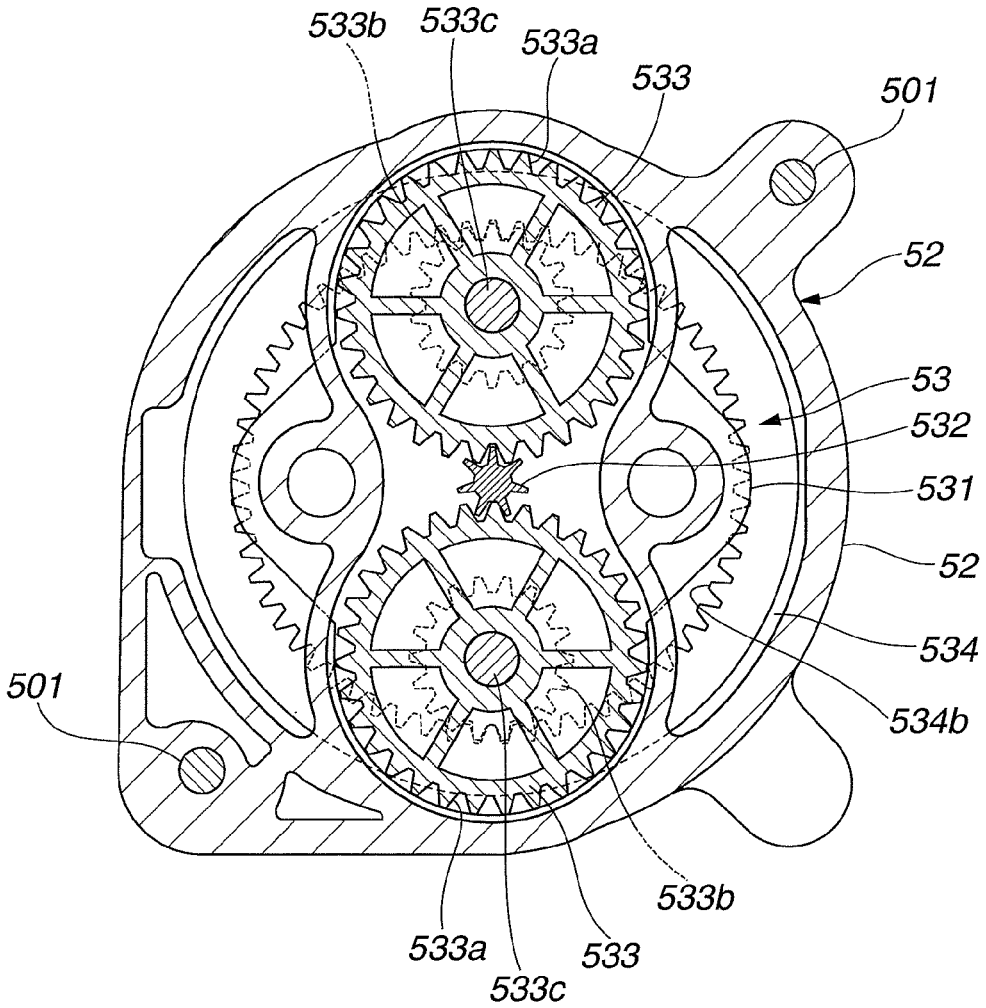
FIG. 8 is a longitudinal sectional view taken along a section line VIII-VIII of FIG. 5.

As shown in FIGS. 4, 7, and 8, the planetary gear mechanism 53 includes a planetary carrier plate 531 which is supported within the gear case 52 so as not to be rotated; a sun gear 532 connected to the rotational shaft 512 of the motor 51; two planetary gears 533 which are rotatably supported by the planetary carrier plate 531, and which are engaged with the sun gear 532; and a ring gear 534 which is rotatably supported within the gear case 52, and which includes internal teeth 534*b* engaged with the planetary gears 533.

The sun gear 532 includes a left end portion, and a right end, portion which is a shaft portion, and which is located at a position coaxial with the motor rotational axis O. The right end portion of the sun gear 532 is inserted into and connected to the rotational shaft 512 of the motor 51 so as not to be relatively rotated. Similarly, the left end portion of the sun gear 532 is rotatably inserted to a central hole of the planetary carrier plate 531. With this, the sun gear 532 is rotated coaxially with the motor rotational axis O in accordance with the rotation of the rotational shaft 512, so as to transmit this rotation to the planetary gears 533.

The two planetary gears 533 are rotatably supported on the planetary carrier plate 531 supported within the gear case 52 so as not to be rotated, by shafts 533*c* parallel to the motor rotational axis O. The two planetary gears 533 are engaged with the sun gear 532 and the internal teeth 534*b* of the ring gear 534. Each of the two planetary gears 533 is rotated around the corresponding one of the shafts 533*c* in accordance with the rotation of the sun gear 532. With this, the two planetary gears 533 transmit this rotation to the ring gear 534. Besides, each of the planetary gears 533 has a teeth number of a teeth portion which is engaged with the internal teeth 534*b* of the ring gear 534, and which is smaller than a teeth number of a teeth portion which is engaged with the sun gear 532, for increasing the reduction gear ratio of the planetary gear mechanism.

The ring gear 534 is rotationally supported within the gear case 52 coaxially with the motor rotational axis O. The ring gear 534 is engaged with the planetary gears 533. The ring gear 534 is rotated around the motor rotational axis O to decrease the speed, in accordance with the rotations of the planetary gears 533 around the shafts 533*c* by the rotation of the sun gear 532. The ring gear 534 transmits this speed reduced rotation to a rotor 552 (described later) of the electromagnetic clutch 55.

The clutch case 54 is fixed to the left end portion of the gear case 52 by four bolts 502 parallel to the motor rotational axis O so that the central axis of the cylindrical shape of the clutch case 54 corresponds to the motor rotational axis O.

The electromagnetic clutch 55 is received within the clutch case 54. The electromagnetic clutch 55 includes a field core 551 which is fixed within the clutch case 54, and which constitutes an electromagnet; a magnetic rotor 552 which is rotatably supported coaxially with the motor rotational axis O; and a magnetic armature 553 which is located adjacent to an attraction surface of the rotor 552 to confront the attraction surface of the rotor 552, and which is rotatably supported coaxially with the motor rotational axis O.

The rotor 552 is rotatably supported within the clutch case 54. The rotor 552 is rotatably supported to be rotated relative to a shaft 554 disposed coaxially with the motor rotational axis O. The rotor 552 includes a serration 552*a* which is formed on an outer circumference of an end portion of a cylindrical shape of a rotation shaft portion extending toward the ring gear 534. This serration 552*a* of the rotor 552 is mounted in a shaft hole 534*a* of the ring gear 534 so as not to be rotated. By this serration 552*a*, the rotor 552 is rotated as a unit with the ring gear 534 coaxially with the motor rotational axis O.

The armature 553 is supported to be rotated as a unit with the shaft 554. The armature 553 includes a left side surface to which a sensor rotation plate 561 is fixed. The sensor rotation plate 561 is a part of the rotation sensor assembly 56. The sensor rotation plate 561 includes a side surface on which a plurality of permanent magnets 561*a* are fixed.

The electromagnetic clutch 55 is brought to a disconnection state in which the attraction surface of the rotor 552 and the attraction surface of the armature 553 are disconnected (separated) from each other, in a non-excited state in which the coil of the field core 551 is not energized (the current is not applied to the coil of the filed core 551). With this, it is possible to manually perform the open operation and the close operation of the back door 2. Moreover, in an excited state in which the coil of the field core 551 is energized (the current is applied to the coil of the field core 551), the electromagnetic clutch 55 is brought to a connection state in which the armature 553 is attracted on the attraction surface of the rotor 552, and the armature 553 and the rotor 552 are rotated as a unit with each other. With this, the rotation of the motor 51 is transmitted through an output lever 65 to the back door 2 to enable the electric open and close operation.

Besides, a first input portion corresponds to the sun gear 532 in this embodiment. Similarly, a first output portion corresponds to the armature 553 or the shaft 554 of the electromagnetic clutch 55. However, the present invention is not limited to this embodiment. For example, in a case where the power door opening/closing apparatus 4 does not include the electromagnetic clutch 55, the first output portion corresponds to the ring gear 534.

The sensor cover 57 has a substantially disc shape. The sensor cover 57 is fixed to close the left end portion of the clutch case 54 by the bolts 502 parallel to the motor rotational axis O. A rotation sensor circuit board 562 is fixed on the sensor cover 57. Rotation sensors (Hall elements) 562*a* arranged to sense the rotation of the sensor rotation plate 561, that is, the rotations of the permanent magnets 561*a* are mounted to the rotation sensor circuit board 562. The rotation sensors 562*a* sense a rotation angle and a rotation direction of the sensor rotation plate 561 rotating as a unit with the armature 553. The detection signal of the rotation sensors 562 is transmitted to a control apparatus (not shown). By a calculation of the control apparatus, an opening and closing position and an opening and closing direction of the back door 2 are sensed. Besides, the rotation sensor assembly 56 is constituted by the sensor rotation plate 561, the rotation sensor circuit board 562, and the permanent magnets 561*a*. Besides, the rotation sensors 562*a* may be constituted by a rotary encoder, in place of the Hall element.

The second unit 6 includes a cylindrical gear case 61 which is connected to a left end portion of the clutch case 54 through the sensor cover 57 by bolts 601 which are fixing members parallel to the motor rotational axis O; a cover 62 which is fixed to a left end portion of the gear case 61; a planetary gear mechanism 63 which is received within the gear case 61, and which constitutes a second transmission mechanism; a mounting bracket 64 which is fixed on a left side surface of the cover 62; and the output lever 65 which is for outputting the rotation of the motor 51.

The gear case 61 has a cylindrical shape. The gear case 61 includes an inner circumference surface on which internal teeth 611 constituting a part of the planetary gear mechanism 63 is formed.

The cover 62 is fixed to the left end portion of the gear case 61 by the bolts 602 parallel to the motor rotation axis O. The cover 62 closes the left end portion of the gear case 61.

Besides, the gear case 61 and the cover 62 in this embodiment correspond to a second unit case in the present invention. However, the present invention is not limited to this embodiment. For example, it is optional to employ a structure in which a ring gear including the internal teeth 611 formed on an inner circumference surface is fixed within the gear case 61 so as not to rotate.

The planetary gear mechanism 63 includes a first speed reduction section arranged to reduce the speed of the rotation outputted from the armature 553 of the electromagnetic clutch 55, and a second speed reduction section arranged to further reduce the speed of the rotation of the first speed reduction section.

Figure 9:
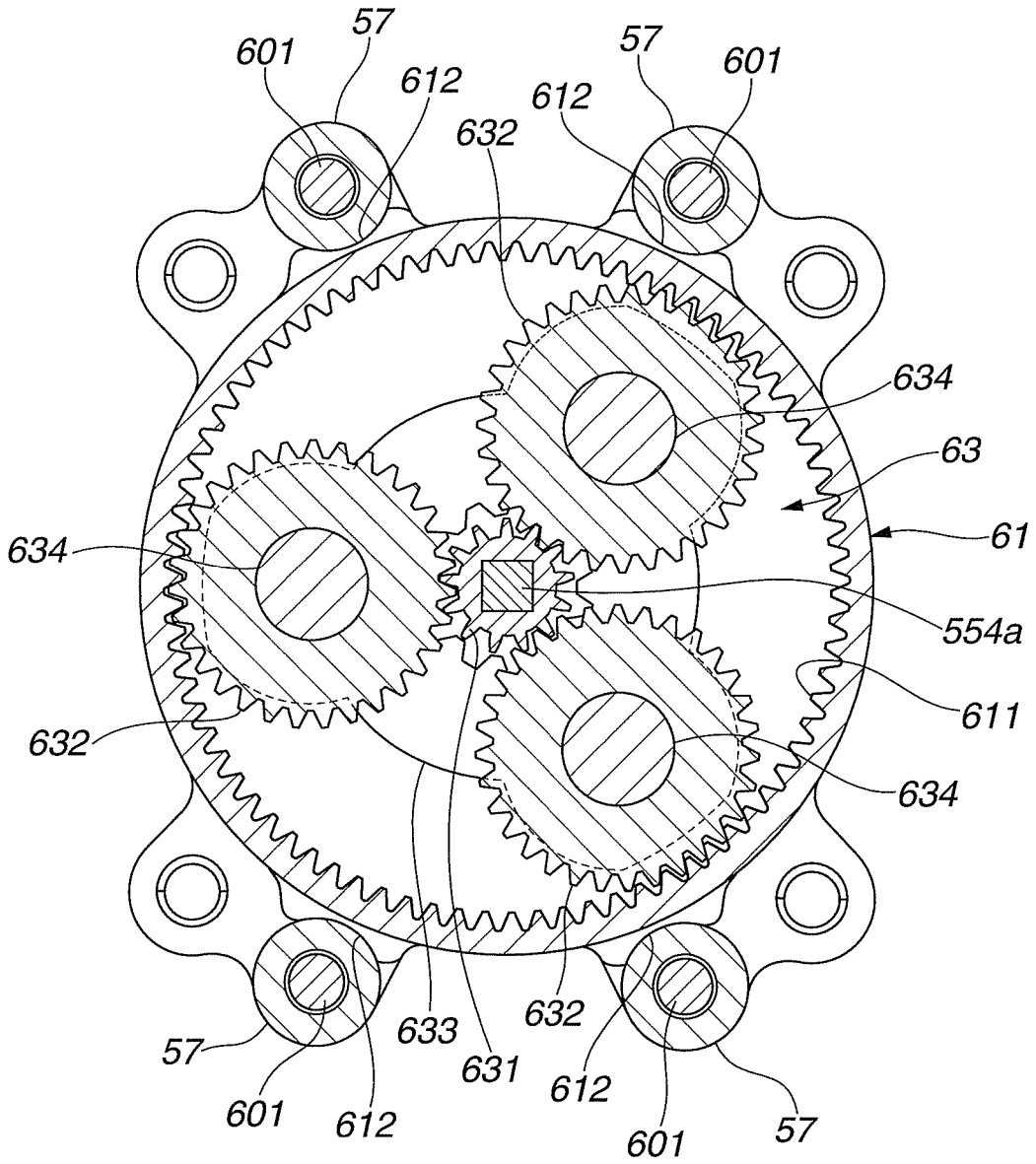
FIG. 9 is a longitudinal sectional view taken along a section line IX-IX of FIG. 5.

As shown in FIGS. 4, 7, and 9, the first speed reduction section includes the internal teeth 611 formed on the inner circumference surface of the gear case 61; a first sun gear 631 which is arranged to rotate as a unit with the armature 553 of the electromagnetic clutch 55; three first planetary gears 632; a first planetary carrier plate 633 rotatably supporting the first planetary gears 632.

The second speed reduction section includes the internal teeth 611 formed on the inner circumference surface of the gear case 61; a second sun gear 635 which is arranged to rotate as a unit with the first planetary carrier plate 633; three second planetary gears 636; and a second planetary carrier plate 637 rotatably supporting the second planetary gears 636.

The first sun gear 631 is mounted on a rectangular column portion 554*a* formed at the left end portion of the shaft 554. With this, the first sun gear 631 is rotated around the motor rotational axis O as a unit with the armature 553 of the electromagnetic clutch 55 through the shaft 554.

The first planetary carrier plate 633 includes a central hole. A serration 635*a* formed at an end portion of the second sun gear 635 is mounted in the central hole of the first planetary carrier plate 633, so that the first planetary carrier plate 633 rotates as a unit with the second sun gear 635.

Each of the first planetary gears 632 is supported on the first planetary carrier plate 633 by a shaft 634 parallel to the motor rotation axis O. Moreover, the first planetary gears 632 are engaged with the first sun gear 631 and the internal teeth 611 of the gear case 61. With this, the first planetary gears 632 are rotated around the motor rotation axis O while each of the first planetary gears 632 is rotated around the corresponding one of the shafts 634 in accordance with the rotation of the first sun gear 631 rotating as a unit with the armature 553. With this, the first planetary carrier plate 633 is rotated around the motor rotation axis O to reduce the speed by the rotation of the first planetary gears 632 around the motor rotation axis O, so that the first planetary carrier plate 633 transmits this speed reduced rotation to the second sun gear 635.

As described above, the serration 635*a* of the second sun gear 635 is mounted in the central hole of the first planetary carrier plate 633. With this, the second sun gear 635 is rotated around the motor rotation axis O as a unit with the rotation of the first planetary carrier plate 633, that is, the rotation of the first planetary gears 632 around the motor rotation axis O.

The second planetary carrier plate 637 includes a center hole 637*a*. A serration 66*a* formed at a right end portion of an output shaft 66 is mounted in this center hole 637*a* of the second carrier plate 637. With this, the second planetary carrier plate 637 is rotated around the motor rotation axis O as a unit with the output shaft 66 and the output lever 65.

Each of the second planetary gears 636 is rotatably supported on the second planetary carrier plate 637 by a shaft 638 parallel to the motor rotation axis O. Moreover, the second planetary gears 636 are engaged with the second sun gear 635 and the internal teeth 611 of the gear case 61. Each of the second planetary gears 636 is rotated around the motor rotation axis O while the each of the second planetary gears 636 is rotated around the corresponding one of the shafts 638 in accordance with the rotation of the second sun gear 635 rotating as a unit with the first planetary carrier plate 633. With this, by the rotations of the second planetary gears 636 around the motor rotation axis O, the second planetary carrier plate 637 further reduces the speed of the rotation of the first speed reduction section, and rotates around the motor rotation axis O. Then, the second planetary carrier plate 637 transmits this rotation to the output shaft 66.

Besides, the first sun gear 631 in this embodiment corresponds to a second input portion in the present invention. Similarly, the second planetary carrier plate 637 corresponds to a second output portion in the present invention. However, the present invention is not limited to this embodiment. For example, when the planetary gear mechanism 63 is constituted only by the first speed reduction section, the first planetary carrier plate 633 corresponds to the second output portion.

The output lever 65 is fixed at the left end portion of the output shaft 66 which protrudes from the left end surface of the cover 62, by bolts 603 coaxially with the motor rotation axis O. With this, the output lever 65 is rotated as a unit with the output shaft 66 and the second planetary carrier plate 637. The output lever 65 includes a spherical joint portion 651 provided at the end portion of the output lever 65. The spherical joint portion 651 of the output lever 65 is connected to the door hinge 3. With this, when the output lever 65 is pivoted a predetermined angle, the back door 2 is moved in the open direction or in the close direction.

The mounting bracket 64 is fixed to a left side surface of the cover 62 by the bolts 602 and bolts 604. The mounting bracket 64 includes a mounting portion 641 which is provided at a front portion of the mounting bracket 64, and which is tightened to the vehicle body 1 by bolts (not shown).

In the assembly operation of the power door opening/closing apparatus 4, the first unit 5 and the second unit 6 are previously assembled independently. The sensor cover 57 fixed to the left end portion of the clutch case 54 of the assembled first unit 5 is connected to the right end portion of the gear case 61 of the second unit 6 by the bolts 601. With this, at the same time, the rectangular column portion 554*a* of the shaft 554 of the first unit 5 is connected to the first sun gear 631 of the second unit 6. Besides, the sensor cover 57 includes a plurality of cylindrical protruding portions 571 (four in this embodiment) which are formed on the outer circumference surface of the sensor cover 57, which protrude toward the gear case 61, and in which the bolts 601 are screwed. Moreover, the gear case 61 includes a plurality of recessed portions 612 (cf. FIG. 9) (four in this embodiment) which are formed on the outer circumference surface of the gear case 61 at positions corresponding to the cylindrical protruding portions 571 of the sensor cover 57, with which parts of the cylindrical protruding portions 571 are engaged, and which have recessed arc surfaces. Accordingly, in the joint operation of the sensor cover 57 and the gear case 61, it is possible to accurately position the second unit 6 with respect to the first unit 5 by adjusting the cylindrical protruding portions 571 of the sensor cover 57 to the recessed portions 612 of the gear case 61.

Next, the operation of the power door opening/closing apparatus 4 is illustrated.

In a case where the motor 51 and the electromagnetic clutch 55 are energized when the back door 2 is positioned at the close position (or the open position), the rotation shaft 512 of the motor 51 is rotated in the normal direction (or in the reverse direction). In the electromagnetic clutch 55, the armature 553 is attracted on the rotor 552 to be brought to the connection state. With this, the rotation of the rotation shaft 512 of the motor 51 is inputted to the sun gear 532 of the planetary gear mechanism 53 of the first unit 5. The speed of this rotation is reduced. The speed-reduced rotation is outputted from the ring gear 534.

Figure 6:
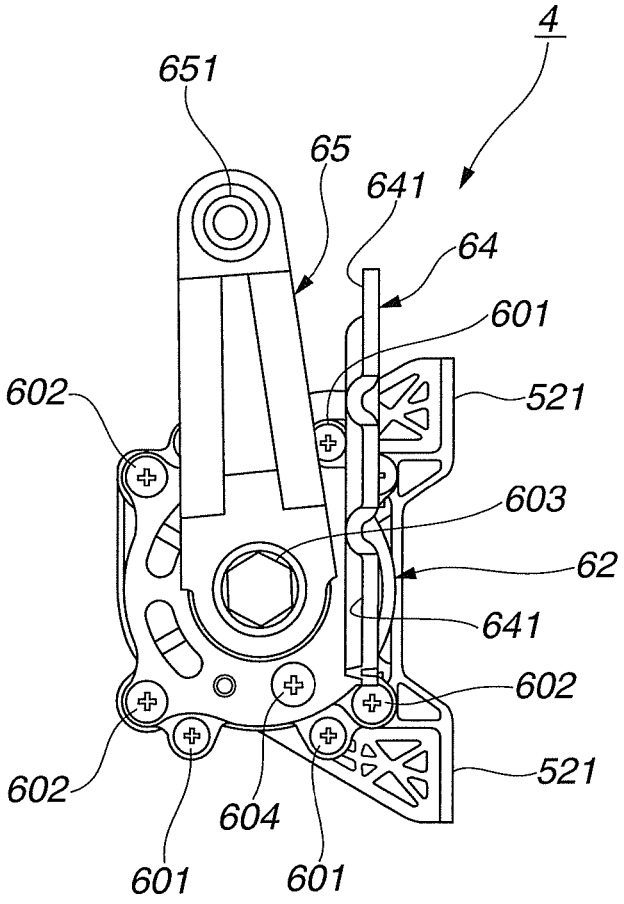
FIG. 6 is a front view showing the power door opening/closing apparatus of FIG. 2.

The rotation outputted from the ring gear 534 of the first unit 5 is transmitted to the electromagnetic clutch 55 which is in the connection state. This rotation is outputted from the shaft 554 rotating as a unit with the armature 553. The rotation outputted from the shaft 554 is inputted to the first sun gear 631 of the planetary gear mechanism 63 of the second unit 6. The speed of this rotation is further reduced. The speed-reduced rotation is transmitted to the second sun gear 635 rotating as a unit with the first planetary carrier plate 633. The speed of the rotation of the second sun gear 635 is further reduced. This speed-reduced rotation is transmitted to the second planetary carrier plate 637. The speed-reduced rotation of the second planetary carrier plate 637 is transmitted through the output shaft 66 to the output lever 65. With this, the output lever 65 is rotated a predetermined angle around the motor rotation shaft 0 in the clockwise direction (or in the counterclockwise direction) in FIG. 6. With this, the back door 2 is moved from the close position (or the open position) in the open direction (or in the close direction) through the door hinge 3.

When the electromagnetic clutch 55 is in the deenergized state, the electromagnetic clutch 55 is in the disconnection state. In this state, the open and close movement of the back door 2 by the manual operation is transmitted through the door hinge 3, the output lever 65, and the output shaft 66 to the planetary gear mechanism 63 of the second unit 6. However, the open and close movement of the back door 2 by the manual operation is not transmitted to the planetary gear mechanism 53 and the motor 51 of the first unit 5. Accordingly, it is possible to manually open and close the back door 2 by a light force.

As described above, the power door opening/closing apparatus 4 according to this embodiment of the present invention includes the first unit 5 including the electrical components such as the motor 51, the electromagnetic clutch 55, and the rotation sensor assembly 56; and the second unit 6 which does not include the electric components. The first unit 5 and the second unit 6 are separately constituted. Accordingly, the confirmation of the actuation of the electrical components needs only for the first unit 5. Consequently it is possible to readily perform the single confirmation of the actuation of the components. Therefore, it is possible to improve the productivity.

Moreover, even when the clutch case 54 is detached from the gear case 52 of the first unit 5, the second unit 6 can be connected through the sensor cover 57 to the gear case 52 of the first unit 5. Accordingly, the power door opening/closing apparatus 4 can be varied to a type in which the electromagnetic clutch 55 is provided, and a type in which the electromagnetic clutch 55 is not provided, if necessary.

Moreover, the gear case 61 of the second unit 6 includes the internal teeth 611 formed on the inner circumference surface of the gear case 61. This internal teeth 611 is shared by the first speed reduction section and the second speed reduction section of the planetary gear mechanism 63 of the second unit 6. Accordingly, it is possible to reduce the production cost. Moreover, the gear case 61 has the cylindrical shape having axial both ends which are opened. Accordingly, it is possible to mold the inner teeth 611 on the inner circumference surface of the gear case 61 at the high accuracy. Moreover, in a state where the planetary gear mechanism 63 except for the internal teeth 611 is previously assembled, it is possible to efficiently assemble the planetary gear mechanism 63 except for the internal teeth 611 within the gear case 61.

Moreover, the power door opening/closing apparatus 4 has the substantially cylindrical overall shape. Accordingly, it is possible to decrease the size of the power door opening/closing apparatus 4, and thereby to mount the power door opening/closing apparatus 4 to a small space.

Furthermore, all of the rotational elements and the bolts are parallel to the motor rotational axis O. Accordingly, it is possible to assemble the power door opening/closing apparatus 4 from one direction, and thereby to improve the productivity.

Moreover, the sun gear 532, the ring gear 534, and the armature 553 of the first transmission mechanism, and the first planetary gears 632 and the output shaft 66 of the second transmission mechanism are supported to be rotated coaxially with the motor rotation axis O. Accordingly, it is possible to efficiently perform the assembly operation of the power door opening/closing apparatus 4.

Moreover, all of the central axes of the cylindrical shapes of the gear case 52, the clutch case 54, the sensor cover 57, the gear case 61, and the cover 62 correspond to the motor rotation axis O. Accordingly, it is possible to efficiently perform the assembly operation of the power door opening/closing apparatus 4.

Furthermore, the second transmission mechanism is the planetary gear mechanism. The first and second sun gears 631 and 635, and the first and second planetary carrier plates 633 and 637 are disposed coaxially with the motor rotation axis O. Accordingly, it is possible to efficiently dispose the planetary gear mechanism having the large speed reduction ratio within the cylindrical second unit case, that is, the gear case 61.

Although the embodiment of the present invention has been described above by reference to the figures, the invention is not limited to the embodiments described above. Following various forms and modifications are included as long as they are not deviated from the gist of the invention.

(1) The door which is electrically opened and closed by the power door opening/closing apparatus 4 may be a sliding door of a sliding type, and a side door of a swing type which are supported on the side surface of the vehicle body to be opened and closed, in place of the back door 2.

(2) The power door opening/closing apparatus 4 may have no electromagnetic clutch 55.

(3) The first transmission mechanism of the first unit 5 may be a cycloid speed reduction mechanism, in place of the planetary gear mechanism.

(4) The second transmission mechanism of the second unit 6 may be a cycloid speed reduction mechanism, in place of the planetary gear mechanism.

(5) The shaft 554 may be the second input portion, and the armature 553 may be the first output portion. In this case, the shaft 554 is rotatably supported within the gear case 61. When the first unit 5 and the second unit 6 are connected, the shaft 554 is connected to the sensor rotation plate 561 and the armature 553.

(6) The sun gear 631 may be directly connected to the armature 553 without using the shaft 554.

The entire contents of Japanese Patent Application No. 2013-128156 filed Jun. 19, 2013 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A power door opening and closing apparatus arranged to open and close a door by a power of a motor, the power door opening and closing apparatus comprising:

a first unit including the motor, a first unit case connected to the motor, a first transmission mechanism received in the first unit case, and arranged to transmit a rotation of the motor, and a rotation sensor which is received within the first unit case, the rotation sensor being one of a plurality of electrical components, and being arranged to sense a rotation of the first transmission mechanism; and a second unit which includes a second unit case connected to the first unit case by a fixing member, a second transmission mechanism rotatably received within the second unit case, and connected to the first transmission mechanism, and an output shaft connected to an output side of the second transmission mechanism, and arranged to transmit a rotation of the second transmission mechanism to the door, and which does not include an electrical component.

2. The power door opening and closing apparatus as claimed in claim 1, wherein:

the first unit case has a substantially cylindrical shape;

the first unit case is connected to the motor so that the first unit case has a central axis which corresponds to a rotation axis of a rotation shaft of the motor;

the first transmission mechanism is supported to be rotated coaxially to the rotation axis of the rotation shaft of the motor; and the first transmission mechanism includes a first input portion connected to the rotation shaft of the motor, and a first output portion arranged to be rotated in accordance with a rotation of the first input portion.

3. The power door opening and closing apparatus as claimed in claim 2, wherein:

the first transmission mechanism includes an electromagnetic clutch which is received within the first unit case, and which is one of the plurality of electrical components, and the electromagnetic clutch is arranged to switch a connection state in which the first transmission mechanism is arranged to output the rotation of the rotation shaft of the motor from the first output portion, and a disconnection state in which the first transmission mechanism is arranged so as not to output the rotation of the rotation shaft of the motor from the first output portion; and the first output portion is an armature of the electromagnetic clutch.

4. The power door opening and closing apparatus as claimed in claim 2, wherein:

the second unit case has a substantially cylindrical shape;

the second unit case is connected to the first unit case so that the second unit case has a central axis which corresponds to the rotation axis of the rotation shaft of the motor;

the second transmission mechanism is supported to be rotated coaxially with the rotational axis of the rotational shaft of the motor; and the second transmission mechanism includes a second input portion connected to the first output portion, and a second output portion which is arranged to be rotated in accordance with a rotation of the second input portion, and which is connected to the output shaft.

5. The power door opening and closing apparatus as claimed in claim 4, wherein:

the second transmission mechanism is a planetary gear mechanism;

the second input portion is a sun gear of the planetary gear mechanism;

the second output portion is a planetary carrier plate of the planetary gear mechanism; and the second unit case includes internal teeth of the planetary gear mechanism which are formed on an inner circumference surface of the second unit case.

6. A method of assembling a power door opening and closing apparatus as claimed in claim 1, the method comprising:

assembling the first unit including the motor, the first unit case, the first transmission mechanism, and the rotation sensor, assembling the second unit including the second unit case, the second transmission mechanism, and the output shaft, and connecting the first unit case to the second unit case, wherein the first unit and the second unit are assembled independently.

* * * * *